US008465605B2

(12) United States Patent
Eickemeyer et al.

(10) Patent No.: US 8,465,605 B2
(45) Date of Patent: Jun. 18, 2013

(54) METHOD FOR THE PRODUCTION AND USE OF SEMI-FINISHED PRODUCTS ON THE BASIS OF NICKEL, HAVING A RECRYSTALLIZATION CUBE TEXTURE

(75) Inventors: Jörg Eickemeyer, Dresden (DE); Dietmar Selbmann, Colmnitz (DE); Horst Wendrock, Kleinthiemig (DE); Bernhard Holzapfel, Kreischa (DE)

(73) Assignee: Leibniz-Institut für Festkörper-und Werkstoffforschung Dresden e.V., Dresden (DE)

( * ) Notice: Subject to any disclaimer, the term of this patent is extended or adjusted under 35 U.S.C. 154(b) by 1262 days.

(21) Appl. No.: 11/886,348

(22) PCT Filed: Mar. 15, 2006

(86) PCT No.: PCT/EP2006/060774

§ 371 (c)(1),
(2), (4) Date: Sep. 17, 2007

(87) PCT Pub. No.: WO2006/097501

PCT Pub. Date: Sep. 21, 2006

(65) Prior Publication Data

US 2009/0008000 A1 Jan. 8, 2009

(30) Foreign Application Priority Data

Mar. 16, 2005 (DE) ..... 10 2005 013 368

(51) Int. Cl.
*C22F 1/10* (2006.01)
*C22C 19/03* (2006.01)

(52) U.S. Cl.
USPC ..... 148/676; 148/426

(58) Field of Classification Search
USPC ..... 148/676, 677, 426
See application file for complete search history.

(56) References Cited

U.S. PATENT DOCUMENTS 5,741,377 A 4/1998 Goyal et al.
5,964,966 A 10/1999 Goyal et al.

(Continued)

FOREIGN PATENT DOCUMENTS

DE 100 05 861 A1 10/2000
DE 103 42 965 6/2005
WO WO 2005/024077 3/2005

OTHER PUBLICATIONS

English Machine Translation of DE 10005861 A1 (2000).*

(Continued)

*Primary Examiner* — Jessee R. Roe
(74) *Attorney, Agent, or Firm* — Collard & Roe, P.C.

(57) ABSTRACT

A nickel-based semi-finished product, for making a high-temperature superconductor, embodied in the form of a strip or flat wire is produced and used as a base for physical-chemical coatings provided with a high-quality intense microstructural orientation. The semi-finished product has an improved granular structure provided with a stable cube texture. A fusion or powder metallurgy process including mechanical alloys makes a semi-finished product including a technically pure Ni or Ni alloy containing an Ag additive in a specified microalloy range. The product is shaped as a strip or flat wire by hot- and cold forming processes with a thickness reduction >50% The product is softened by annealing at 500 to 850° C. and is subsequently quenched. Afterwards, the product is exposed to the 80% cold shaping. A recrystallization annealing treatment is carried out to obtain an entire cubic texture.

5 Claims, 4 Drawing Sheets

U.S. PATENT DOCUMENTS

| | | | | |
|---|---|---|---|---|
| 6,106,615 | A | 8/2000 | Goyal et al. | |
| 6,458,223 | B1 * | 10/2002 | Thieme et al. | 148/435 |
| 2003/0211948 | A1 * | 11/2003 | Paranthaman et al. | 505/237 |
| 2007/0062613 | A1 | 3/2007 | Eichemeyer et al. | |

OTHER PUBLICATIONS

International Search Report.

*Texturen metallischer Werkstoffe* [Textures of Metallic Materials], Wassermann, G., Springer, Berlin, 1939 (Spec. p. 2) (will follow).

*Eur. Phys. Journ. B*, Hammerl, H., et al., 2002, pp. 299-301 (Spec. p. 3) (will follow).

*Texturen metallischer Werkstoffe* [Textures of Metallic Materials], Wassermann, G., Springer, Berlin, 1939, pp. 106-117 (Spec. p. 2).

*Eur. Phys. Journ. B*, Hammerl, H., et al., 2002, vol. 27, pp. 299-301 (Spec. p. 3).

* cited by examiner

METHOD FOR THE PRODUCTION AND USE OF SEMI-FINISHED PRODUCTS ON THE BASIS OF NICKEL, HAVING A RECRYSTALLIZATION CUBE TEXTURE

CROSS REFERENCE TO RELATED APPLICATIONS

Applicants claim priority under 35 U.S.C. §119 of German Application No. DE 10 2005 013 368.1 filed Mar. 16, 2005. Applicants also claim priority under 35 U.S.C. §365 of PCT/EP2006/060774 filed Mar. 15, 2006. The international application under PCT article 21(2) was not published in English.

TECHNICAL FIELD

The invention relates to a method for the production of semi-finished products on the basis of nickel, in the form of strip or flat wire, having a recrystallization cube texture, and the use of the semi-finished products produced.

The semi-finished products can particularly be used as a substrate for physical-chemical coatings having a high degree of microstructural orientation. Such substrates are suitable, for example, as substrates for chemical coatings such as those used in the field of high-temperature superconduction. In this case, their use takes place in superconductive magnets, transformers, motors, tomographs, or superconductive flow paths.

STATE OF THE ART

It is known that polycrystalline metals having a cubic-surface-centered lattice, such as nickel, copper, and aluminum, can form a marked texture having a cubic layer after prior cold-forming by means of rolling, during subsequent recrystallization (G. Wassermann: Texturen metallischer Werkstoffe [Textures of metallic materials], Springer, Berlin, 1939). Metal strips textured in this manner, particularly nickel strips, are also used as a substrate for metallic coatings, ceramic buffer layers, and ceramic superconductor layers (U.S. Pat. No. 5,741,377). The suitability of such metal strips as a substrate material is decisively dependent on the degree of texturing that can be achieved, and the stability of the texture in the range of temperatures at which the coating methods operate.

Textured semi-finished products for the production of high-temperature superconductors are already known, which consist of Ni—Cr, Ni—Cr—V, Ni—Cu, and similar alloys (U.S. Pat. No. 5,964,966; U.S. Pat. No. 6,106,615).

Also, Ni alloys with Mo and W are known for these purposes (DE 100 05 861 C1). It has also already been proposed to add up to maximally 0.3 atom-% Ag to such Ni alloys (DE 103 42 965.4).

All of the known metal strips of this type, having a cube texture that has been formed by means of recrystallization, have a structure having equiaxial grains, which means that with reference to the strip plane, they have approximately equal length and width. For theoretical considerations, however, grain elongation in the longitudinal direction should be advantageous for current transport during superconduction, and lead to greater currents that can be transferred (Hammerl, H., et al., Eur. Phys. Journ. B (2002) 299-301). However, it has not been possible until now to produce substrate strips having a cube texture with a simultaneously greatly stretched grain structure.

The known semi-finished products have the following disadvantages:

Recrystallized nickel or its alloys, having a cube texture, have grains that have approximately the same expanse in the lengthwise direction as in the crosswise direction, after cold forming and recrystallization annealing, nickel has a strong tendency to form a coarse grain structure, which is disadvantageous for achieving the high degree of cube texture, cold-formed Ni strips have a strong tendency to form grain border ditches during recrystallization heat treatment, particularly at higher temperatures (800 to 1150° C.), substrate material having grain border ditches is not well suited as a substrate for epitactic layer deposition, for example for buffer layers and superconductor layers.

DISCLOSURE OF THE INVENTION

The invention is based on the task of developing a method for the production of semi-finished products on the basis of nickel, which possesses improved usage properties for use as a substrate for physical-chemical coatings, with a high degree of microstructural orientation. In particular, the semi-finished product is supposed to have a stretched grain shape, while having a stable cube texture, and the stretched grain is supposed to be maintained even after further thermal treatment at high temperatures, for the purpose of oxide layer growth.

This task is accomplished with the features characterized in the claims.

The method according to the invention is characterized in that first, a starting semi-finished product is produced by way of a melt-metallurgy or powder-metallurgy process, with the inclusion of mechanical alloying, which product consists of technically pure Ni or an Ni alloy, in which an Ag addition in the microalloying range of at least 10 atom ppm and maximally 1000 atom ppm is contained. This starting semi-finished product is processed into strip or flat wire having an intermediate dimension, by means of hot-forming with subsequently cold-forming at >50% thickness reduction. In this intermediate dimension, the semi-finished product is annealed, losing its solidity, in the temperature range between 500° C. and 850° C., whereby the higher temperatures are used for the higher Ag contents, and then quenched. Subsequently, this intermediate product is cold-formed to a high degree >80%. As a final step, recrystallization annealing treatment is performed in order to achieve a complete cube texture.

The final recrystallization annealing treatment is carried out as a function of the alloy content in the nickel, at temperatures of 500° C. to 1200° C., preferably at 850° C.

The semi-finished product can advantageously be heat-treated in an oxidizing atmosphere, after or during the recrystallizing annealing, for the purpose of growing a cube-textured NiO layer with a texture content of >90%.

It is also advantageous if an Ni alloy that contains not only the Ag addition but also Mo and/or W as alloy elements is used for the starting semi-finished product.

The formation of a high degree of cube texture is promoted with the Ag addition according to the invention. Furthermore, the metal strip with stretched grain makes possible the growth of an NiO layer provided with a cube texture to a high degree, which layer also has stretched grains.

The semi-finished product can be used, according to the invention, as a substratum for physical-chemical coatings having a high degree of microstructural orientation, particularly for the production of high-temperature superconductors in wire form or strip form.

The invention will be explained in greater detail below, using exemplary embodiments, with which successful testing of the invention is documented.

BRIEF DESCRIPTION OF THE FIGURES

The following explanations regarding the figures show the positive results of the use of the invention within the framework of the exemplary embodiments described.

EXAMPLE 1

Figure 1:
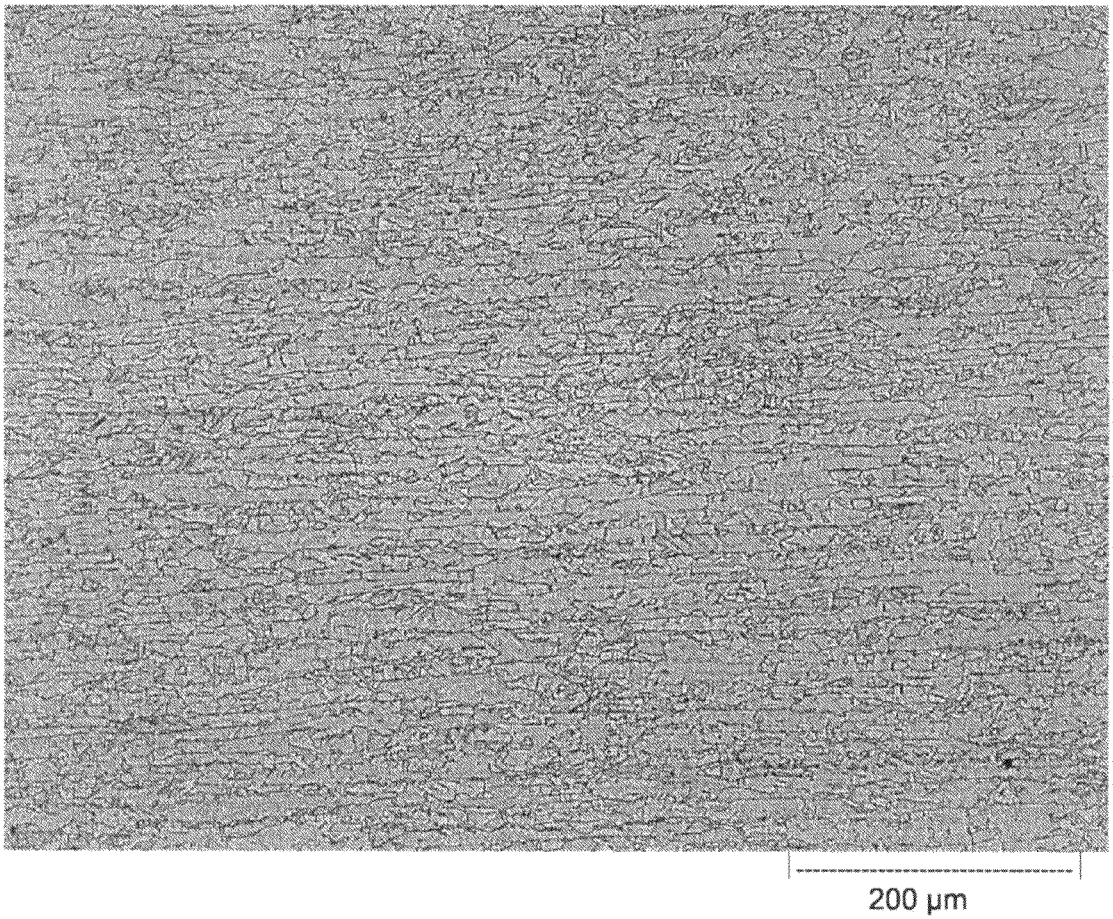
FIG. 1 shows the stretched structure of nickel with 0.01 atom-% silver after hot-rolling at 850° C. and subsequent cold-rolling with a thickness reduction of 85% and an annealing treatment with partial recrystallization at 550° C. over 30 min (longitudinal ground section, etched).

Technically pure nickel, for example with a degree of purity of 99.9 atom percent nickel, is cast into an ingot mold while alloying in 0.025 atom percent silver. The ingot is rolled at 850° C. to the square dimension (22×22) $mm^2$, annealed to homogenize it, and quenched. Subsequently, the square material is machined to obtain a defect-free surface for the subsequent cold-deformation by means of rolling. The cold-rolling is at first carried out at a degree of rolling of over 50 percent thickness reduction, from 20 mm to 3 mm thickness, in this case 85% thickness reduction. The subsequent annealing treatment at 650° C. over 30 min brings about recrystallization with a proportion of stretched grains. FIG. 1 shows a typical structure image (nickel with 0.01 atom percent silver). This structure with stretched grains serves as the starting state for further processing to produce the desired nickel strip with cube texture and grains stretched in the longitudinal direction.

Figure 2:
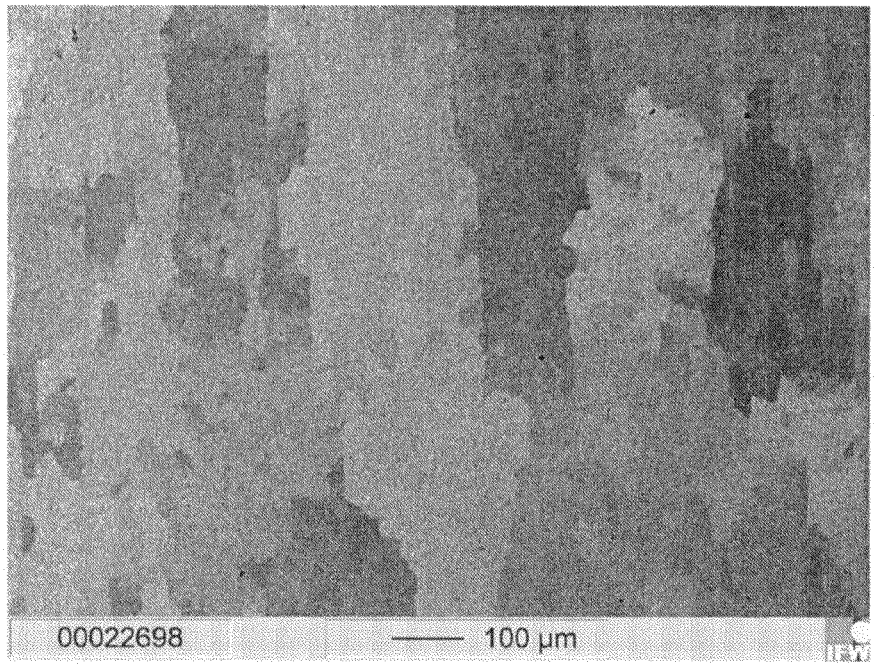
FIG. 2 shows stretched grains on the surface of a strip having a thickness of 80 μm, made of nickel with 0.025 atom-% silver, which was subjected to intermediate annealing at 650° C. over 30 min at a thickness of 3 mm, subsequently greatly cold-formed to a thickness of 80 μm, and finally annealed at 550° C. over 30 min (raster electron image).
Figure 3:
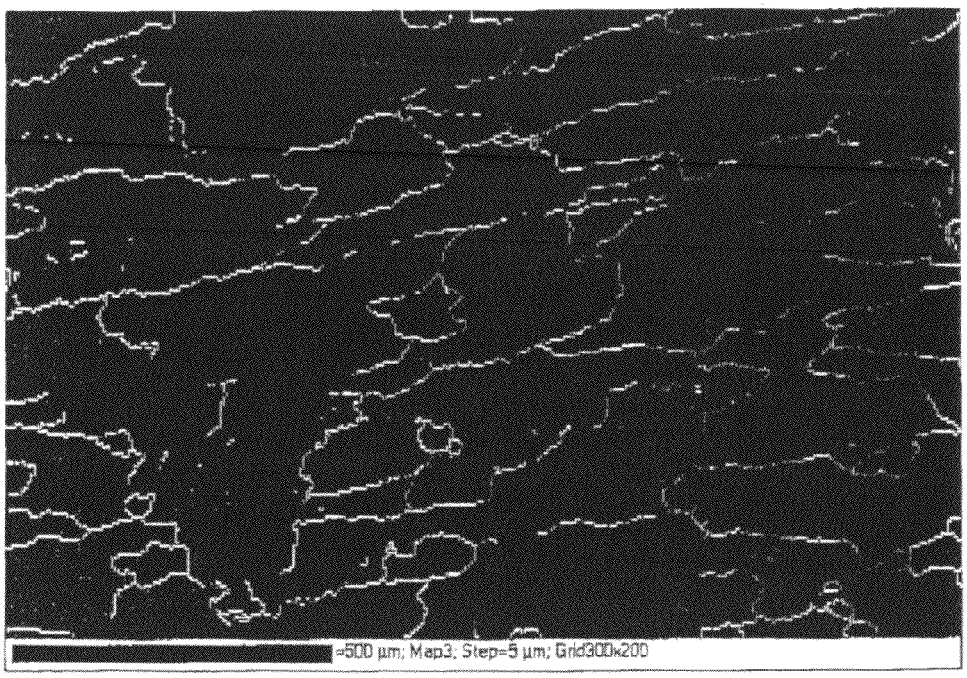
FIG. 3 shows stretched grains with a cube layer on the surface of a strip having a thickness of 80 μm, made of nickel with 0.025 atom-% silver, after intermediate annealing at 650° C. over 30 min at a thickness of 3 mm, subsequent great cold-deformation to a thickness of 80 μm, and final annealing at 550° C. over 30 min (orientation mapping using the raster electron microscope).
Figure 3:
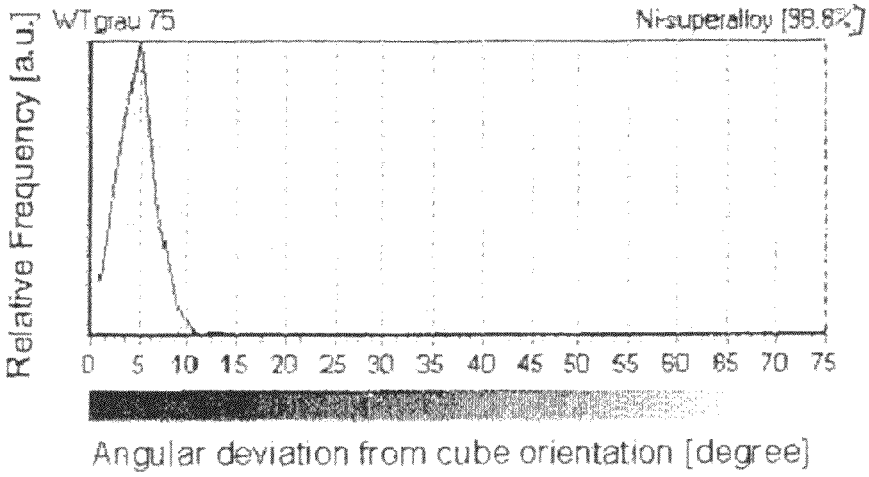

Subsequently, cold-deformation is carried out throughout with a thickness reduction of 97.3%, from 3 mm to 80 μm thickness, and finally, annealing takes place in a non-oxidizing gas atmosphere, at 550° C. over 30 min. The result is grains on the surface of the strip that are several times longer than they are wide, as FIG. 2 shows. At the same time, an extremely sharp recrystallization cube texture is obtained, as is evident from FIG. 3. The proportion of the crystallites with cube layer amounts to 97.5 percent, and the proportion of the small-angle grain borders is 92 percent.

EXAMPLE 2

Technically pure nickel, for example with a degree of purity of 99.9 atom percent nickel, is melted in a vacuum induction furnace while alloying in 0.01 atom percent silver, and cast into an ingot mold. The ingot is rolled at 900° C. to the square dimension (22×22) $mm^2$, annealed to homogenize it, and quenched. Subsequently, the square material is machined to obtain a defect-free surface for the subsequent cold-deformation by means of rolling. The cold-rolling is at first carried out at a degree of rolling of over 50 percent thickness reduction, in this case 85%. The resulting nickel strip has a thickness of 3 mm. It is subsequently annealed at 650° C. over 30 min, and quenched in water. The recrystallization produces a proportion of stretched grains. Subsequently, cold-deformation is carried out throughout with a thickness reduction of 97.3%, proceeding from 3 mm to 80 μm thickness, and finally, annealing takes place in a non-oxidizing gas atmosphere, at 550° C. over 30 min. The result is an almost complete recrystallization cube texture in a stretched grain structure (cf. FIG. 3). Subsequently, the strip is subjected to 2 minutes of oxidation in pure oxygen gas, at 1150° C.

Figure 4:
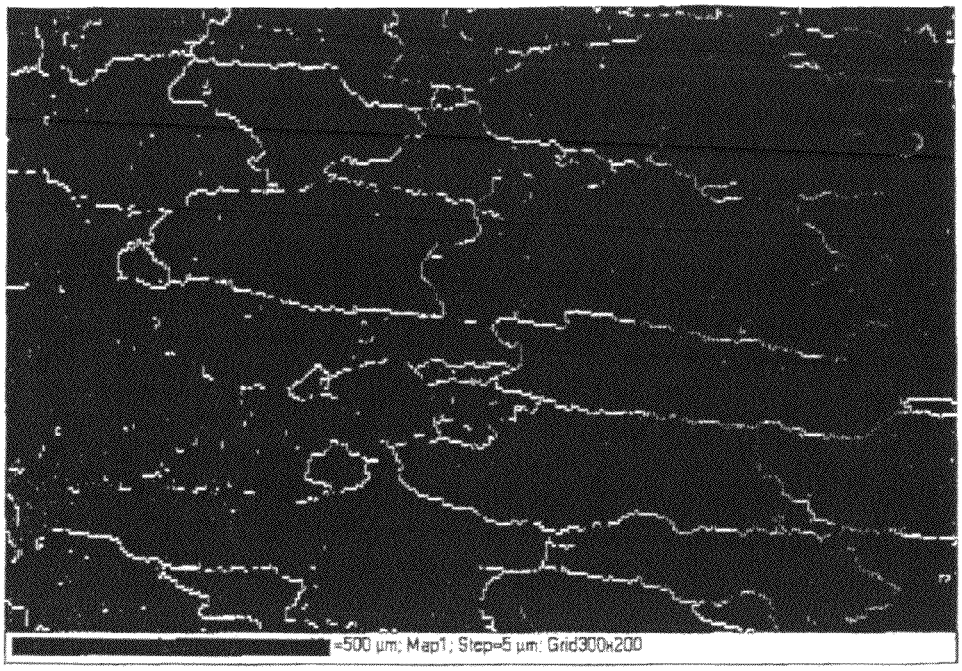
FIG. 4 shows stretched grains with a cube layer of the nickel oxide on the surface of a strip having a thickness of 80 μm, made of nickel with 0.025 atom-% silver, after intermediate annealing at 650° C. over 30 min at a thickness of 3 mm, subsequent great cold-deformation to a thickness of 80 μm, texture annealing at 550° C. over 30 min, and oxidation in oxygen at 1150° C. (orientation mapping using the raster electron microscope).
Figure 4:
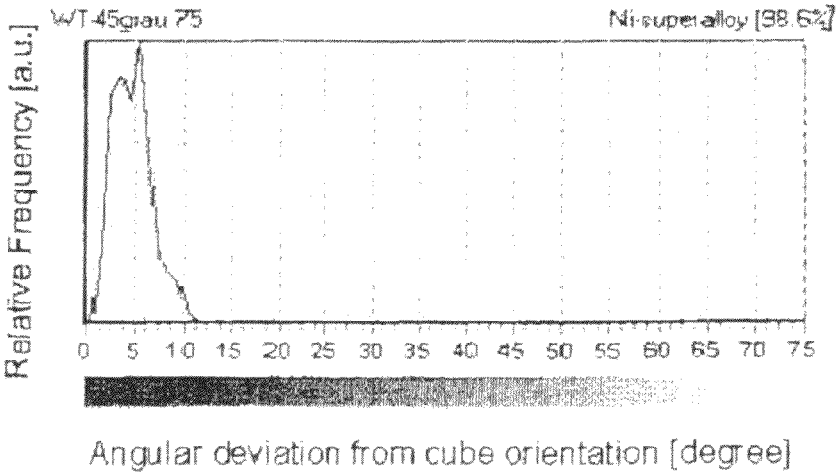

The nickel oxide layer that has formed has a structure with stretched grains, 97% of which have a cube layer (FIG. 4). The proportion of the small-angle grain borders is 96%. This texture is rotated by 45° with regard to the texture of the nickel strip.

EXAMPLE 3

Technically pure nickel is processed by means of powder metallurgy, with the addition of 5.0 atom percent tungsten powder and 0.1 atom-% silver powder. After pressing, tempering, and hot deformation, a rod material of (22×22) $mm^2$ is obtained. The surface is machined to obtain a defect-free surface for the subsequent cold-deformation by means of rolling. The cold-rolling is carried out proceeding from approximately (20×20) $mm^2$, up to a thickness of 3 mm.

Subsequently, annealing takes place at 650° C. over 30 min, then quenching in water. Afterwards, cold-rolling takes place to the finished dimension of 80 μm thickness. The nickel strip obtained is subsequently subjected to 30 minutes of annealing at 850° C. in a reducing atmosphere, for recrystallization. Afterwards, the strip is treated in a second annealing process, over 8 min, at 1150° C., in a reducing atmosphere, in order to adjust a cube layer that is highly resistant to thermal stress.

The invention claimed is:

1. A method for the production of a product on the basis of nickel, having a recrystallization cube texture, wherein first, a starting product is produced by way of a melt-metallurgy or powder-metallurgy process, with the inclusion of mechanical alloying, the starting product being produced by adding Ag into technically pure Ni or a Ni alloy so that the starting product has an Ag addition in a microalloying range of at least 10 atom ppm and maximally 1000 atom ppm, wherein this starting product is processed into strip or flat wire having an intermediate dimension, by hot-forming with subsequent cold-forming at >50% thickness reduction, this strip or flat wire is softened by annealing at a temperature within the temperature range between 500° C. and 850° C., whereby higher temperatures in the temperature range between 500° C. and 850° C. are used for higher Ag contents, thereupon quenching takes place, wherein subsequently, cold-forming occurs to a degree >80%, and wherein finally, recrystallizing annealing treatment is performed in order to achieve a complete cube texture.

2. The method according to claim 1, wherein the final recrystallization annealing treatment is carried out as a function of alloy content in the nickel, at temperatures of 500° C. to 1200° C.

3. The method according to claim 2, wherein the final recrystallization annealing treatment is carried out at a temperature of 850° C.

4. The method according to claim 1, wherein the product is heat-treated in an oxidizing atmosphere, after or during the recrystallizing annealing, for the purpose of growing a cube-textured NiO layer with a texture content of >90%.

5. The method according to claim 1, wherein the Ni alloy having the Ag addition is used for the starting product, the Ni alloy further having at least one of Mo and W.

* * * * *